US010332497B2

(12) United States Patent
Mori

(10) Patent No.: US 10,332,497 B2
(45) Date of Patent: Jun. 25, 2019

(54) ELECTRONIC PERCUSSION

(71) Applicant: ATV corporation, Hamamatsu-shi, Shizuoka (JP)

(72) Inventor: Yoshiaki Mori, Shizuoka (JP)

(73) Assignee: ATV corporation, Shizuoka (JP)

( * ) Notice: Subject to any disclaimer, the term of this patent is extended or adjusted under 35 U.S.C. 154(b) by 84 days.

(21) Appl. No.: 15/566,044

(22) PCT Filed: Apr. 17, 2017

(86) PCT No.: PCT/JP2017/015443
§ 371 (c)(1),
(2) Date: Oct. 12, 2017

(87) PCT Pub. No.: WO2018/078915
PCT Pub. Date: May 3, 2018

(65) Prior Publication Data

US 2019/0051278 A1 Feb. 14, 2019

(30) Foreign Application Priority Data

Oct. 24, 2016 (JP) ..... 2016-207758

(51) Int. Cl.
*G10H 3/06* (2006.01)
*G10H 3/12* (2006.01)
(Continued)

(52) U.S. Cl.
CPC ..... *G10H 3/146* (2013.01); *G10H 1/00* (2013.01); *G10H 1/32* (2013.01); *G10H 3/06* (2013.01);
(Continued)

(58) Field of Classification Search
CPC .. G10G 1/00; G10G 7/02; G10G 7/00; G10G 3/00; G10G 1/02; G10F 1/08; G10H 1/32; G10H 2250/435; G10H 3/12
See application file for complete search history.

(56) References Cited

U.S. PATENT DOCUMENTS 4,815,353 A 3/1989 Christian
2003/0005816 A1* 1/2003 Stuebner ..... G01H 3/12 84/738
(Continued)

FOREIGN PATENT DOCUMENTS

JP 04-116695 4/1992

OTHER PUBLICATIONS

International Search Report dated Jun. 27, 2017 filed in PCT/JP2017/015443.

*Primary Examiner* — Marlon T Fletcher
(74) *Attorney, Agent, or Firm* — Rankin, Hill & Clark LLP

(57) ABSTRACT

With an electronic percussion 100, a mesh-shaped head 101 is supported by a shell 103 formed into a cylindrical shape. The shell 103 includes an optical sensor 105 inside and a sensor cover body 110 outside. The optical sensor 105 includes a light emitter 105*a* that irradiates light to a back surface 101*b* of the head 101 and a light receiver 105*b* that receives reflected light from the back surface 101*b* of the head 101. This optical sensor 105 is supported by a sensor supporting body 104 at a position adjacent to the back surface 101*b* of the head 101. The sensor cover body 110 is formed so as to have a size with which the sensor cover body 110 covers the optical sensor 105 at the position that is opposed to the optical sensor 105 on a struck surface 101*a* side, which is opposite to the back surface 101*b* of the head 101 and which faces the optical sensor 105.

9 Claims, 16 Drawing Sheets

(51) Int. Cl.

| | |
|---|---|
| ***G10H 3/14*** | (2006.01) |
| ***G10H 1/32*** | (2006.01) |
| ***G10H 1/00*** | (2006.01) |

(52) U.S. Cl.
CPC ..... *G10H 3/14* (2013.01); *G10H 2220/461* (2013.01); *G10H 2230/275* (2013.01)

(56) References Cited

U.S. PATENT DOCUMENTS

| | | | | |
|---|---|---|---|---|
| 2004/0200338 | A1* | 10/2004 | Pangrle | G10H 3/06 84/724 |
| 2006/0219092 | A1* | 10/2006 | Mishima | G10H 1/0008 84/724 |
| 2019/0051278 | A1* | 2/2019 | Mori | G10H 3/146 |

* cited by examiner

ELECTRONIC PERCUSSION

TECHNICAL FIELD

The present invention relates to an electronic percussion that detects an impact to a struck surface beaten by a hand, a stick, a beater, or the like to generate an electronic musical sound.

BACKGROUND ART

Conventionally, there has been provided an electronic percussion that detects an impact to a struck surface beaten by a hand, a stick, a beater, or the like to generate an electronic musical sound. For example, the following Patent Literature 1 discloses an electronic drum (an electronic percussion). This electronic drum (this electronic percussion) includes a laser ranging circuit at a bottom portion of a drum body that supports a vibrating plate (a head) beaten by a stick. In view of this, this electronic drum optically detects a vibration of the vibrating plate to generate an electronic musical sound.

CITATION LIST

Patent Literature

PATENT LITERATURE 1: JP-A-04-116695

However, the electronic drum type electronic percussion described in Patent Literature 1 has the following problem. That is, to obtain a reflected light from a back surface of the vibrating plate, a deposition film formed of metal particles is formed on the back surface of the vibrating plate. Accordingly, received damage and deterioration of the deposition film due to hitting of the vibrating plate is significant, thereby detection accuracy of the vibration is likely to be deteriorated.

The present invention has been made to deal with the problem. An object of the present invention is to provide an electronic percussion that can maintain detection accuracy of a vibration of a head over a long period of time.

SUMMARY OF INVENTION

To achieve the object, as a feature of the present invention, a head, an optical sensor, and a sensor cover body are included. The head is configured such that a struck surface beaten by a player has a semi-translucency that causes a part of irradiated light to transmit and reflects another part of the light. The optical sensor is disposed opposed at one surface side of the head. The optical sensor includes respective light emitter and photoelectric converter. The light emitter is configured to irradiate the head with light. The photoelectric converter is configured to photoelectrically convert a received light. The sensor cover body is disposed at a position that is opposed to the optical sensor and at another surface side of the head. The sensor cover body has a size with which the optical sensor is covered.

With the feature of the present invention thus configured, the electronic percussion includes the optical sensor at the one surface side of the head. Furthermore, the sensor cover body having the size with which the optical sensor is covered is disposed at the other surface side, the opposite side of the one surface. Accordingly, an amount of light (brightness) at a back surface side of the head part to which the optical sensor is opposed decreases and a change in the faint reflected light from the head with a semi-translucency can be detected. In view of this, the electronic percussion according to the present invention can maintain detection accuracy of a vibration of the head over a long period of time.

Another feature of the present invention is as follows. With the electronic percussion, the sensor cover body is disposed opposed at a position separated from the other surface side of the head.

With the other feature of the present invention thus configured, with the electronic percussion, the sensor cover body is disposed opposed at a position separated from the other surface side, which is the side opposite to the one surface, of the head. In view of this, the sensor cover body does not affect the vibration of the head, and the sensor cover body itself is unaffected by the vibration, thereby ensuring maintaining the detection accuracy of the vibration of the head over a long period of time.

Another feature of the present invention is as follows. With the electronic percussion, the sensor cover body is disposed directly on the other surface of the head.

With the other feature of the present invention thus configured, with the electronic percussion, the sensor cover body is disposed directly on the other surface of the head. Therefore, the sensor cover body does not become an obstacle of performance of the electronic percussion and additionally the compact electronic percussion can be configured.

Another feature of the present invention is as follows. With the electronic percussion, the sensor cover body is formed into an annular shape along an outer edge portion of the head.

With the other feature of the present invention thus configured, with the electronic percussion, the sensor cover body is formed into the annular shape along the outer edge portion of the head. Accordingly, when the optical sensor is attached, this allows reducing a load applied to positioning between the optical sensor and the sensor cover body. Furthermore, the electronic percussion can be constituted so as to have a sophisticated design free from a feeling of a foreign body as an appearance design.

Another feature of the present invention is as follows. The electronic percussion further includes a tubular shell and a sensor supporting body. The tubular shell supports the outer edge portion of the head. The sensor supporting body is disposed at a side surface of the shell. The sensor supporting body supports the optical sensor at a position adjacent to the head.

With the other feature of the present invention thus configured, with the electronic percussion, the optical sensor is disposed at the side surface of the shell and at the position adjacent to the head by the sensor supporting body. This allows detecting the vibration of the head precisely at a shorter time. Furthermore, the side in the shell opposed to the head is opened, escaping a shock wave caused by hitting of the head to outside of the shell and ensuring preventing an echo.

Another feature of the present invention is as follows. With the electronic percussion, the optical sensor is disposed at an end of the head on a side opposite to the player side.

With the other feature of the present invention thus configured, with the electronic percussion, the optical sensor is disposed at the end of the head on the side opposite to the player side. This ensures facilitating the performance and also can prevent received damage of the optical sensor and the sensor cover body.

Another feature of the present invention is as follows. With the electronic percussion, the sensor cover body has a side facing the optical sensor. The side is colored with a deep color.

According to the other feature of the present invention thus configured, with the electronic percussion, the sensor cover body has the side facing the optical sensor colored with the deep color. Accordingly, the decreased reflected light from the sensor cover body ensures easy detection of the change in the faint reflected light from the head with a semi-translucency, ensuring improving the detection accuracy of the vibration.

To achieve the object, as another feature of the present invention, a head, an optical sensor, and a sheet-shaped or plate-shaped sensor-opposed body are included.

The head is configured such that a struck surface beaten by a player has a semi-translucency that causes a part of irradiated light to transmit and reflects another part of the light. The optical sensor is disposed opposed at one surface side of the head. The optical sensor includes respective light emitter and photoelectric converter. The light emitter is configured to irradiate the head with light. The photoelectric converter is configured to photoelectrically convert a received light. The sensor-opposed body is disposed directly on the one surface of the head. The sensor-opposed body is configured to reflect the light irradiated by the light emitter.

With the other feature of the present invention thus configured, the electronic percussion includes the plate-shaped or sheet-shaped sensor-opposed body as a reflecting body on the one surface of the head to which the optical sensor is opposed. Therefore, partial peeling and a drop due to the hitting of the head can be less likely to occur. Accordingly, the detection accuracy of the vibration of the head can be maintained over a long period of time. The electronic percussion includes the plate-shaped or sheet-shaped sensor-opposed body. In view of this, mounting and exchanging work of the sensor-opposed body to the head can be easily performed.

Another feature of the present invention is as follows. With the electronic percussion, the sensor-opposed body is formed into an annular shape along an outer edge portion of the head.

With the other feature of the present invention thus configured, with the electronic percussion, the sensor-opposed body is formed into the annular shape along the outer edge portion of the head. Accordingly, when the optical sensor is attached, this allows reducing a load applied to positioning between the optical sensor and the sensor cover body. Furthermore, the electronic percussion can be constituted so as to have the sophisticated design free from the feeling of the foreign body as the appearance design.

DESCRIPTION OF EMBODIMENTS (First Embodiment)

Figure 1:
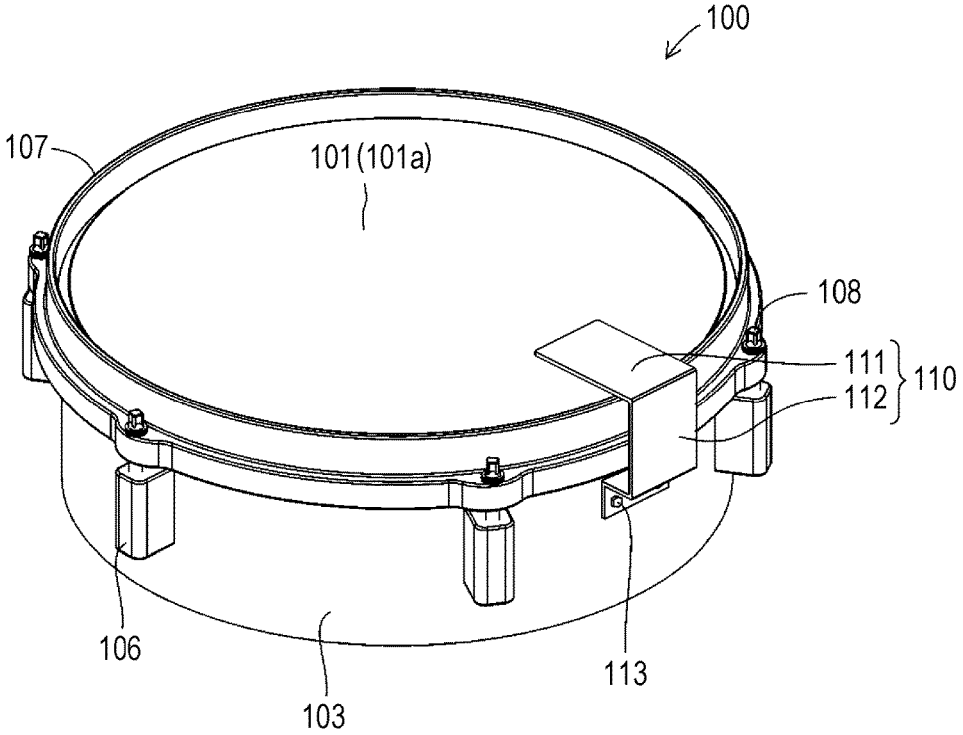
FIG. 1 is a perspective view illustrating a schematic external configuration of an electronic percussion according to a first embodiment of the present invention.
Figure 2:
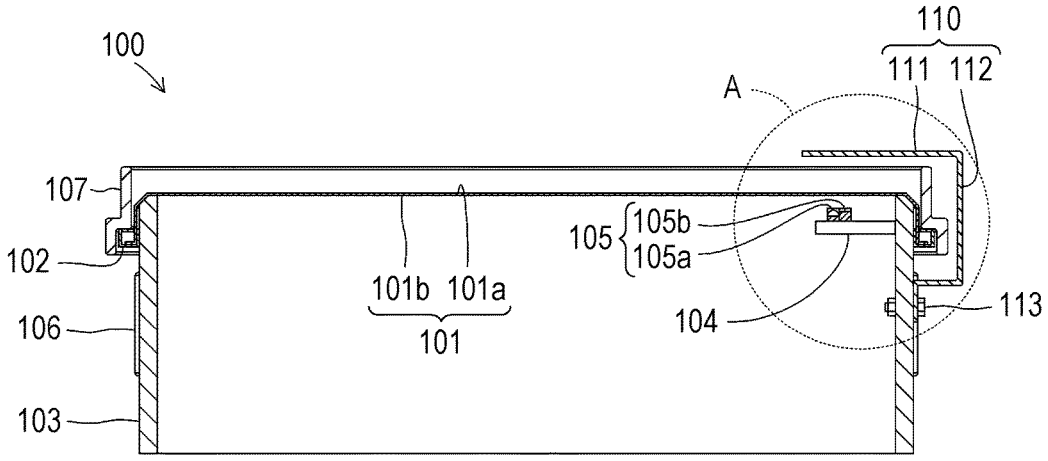
FIG. 2 is a cross-sectional view schematically illustrating a schematic internal configuration of the electronic percussion illustrated in FIG. 1.

The following describes the first embodiment of an electronic percussion according to the present invention with reference to the drawings. FIG. 1 is a perspective view schematically illustrating a schematic external configuration of an electronic percussion 100 according to the present invention. FIG. 2 is a cross-sectional view schematically illustrating a schematic internal configuration of the electronic percussion 100 illustrated in FIG. 1. The drawings to be referred to in this description are schematically illustrated for ease of understanding of the present invention by exaggeratedly illustrating a part of components and the like. Therefore, dimensions, ratios, and the like between the respective components may differ. This electronic percussion 100 is an electronic drum that detects an impact to a struck surface 101*a* beaten by a player (not illustrated) by a stick (not illustrated) to generate an electronic musical sound.

(Configuration of Electronic Percussion 100)

The electronic percussion 100 includes a head 101. The head 101 is a component that vibrates and elastically deforms by a beating operation by the player. The head 101 is configured by forming a cloth material or a resin material into a sheet shape or a thin plate shape. This head 101 is constituted so as to have a semi-translucency that causes a part of irradiated light to transmit and reflects the other part of the light.

Specifically, the head 101 is constituted of the transparent or semi-translucent sheet material or thin plate material made of resin or the cloth material or the resin material formed into a mesh shape. The head 101 of this embodiment is configured by forming the mesh-shaped sheet body into a circular shape in a plan view. An outer edge portion of this head 101 is held by a head frame 102.

The head frame 102 is a component to dispose the head 101 on a shell 103 with the head 101 being tensioned. The head frame 102 is configured by forming a metal material or a resin material into an annular shape. This head frame 102 is fitted to an outer peripheral portion of the shell 103 while holding the outer edge portion of the head 101. In this case, a hoop 107 presses the annular top surface of the head frame 102.

The shell 103 is a component that supports the respective head 101 and optical sensor 105. The shell 103 is configured by forming a metal material, a resin material, or wood into a cylindrical shape. One (the upper side in the drawing) end of this shell 103 is obstructed by the head 101 and the other (the lower side in the drawing) end opens. In view of this, the surface of the head 101 exposed to the outside of the shell 103 constitutes the struck surface 101*a*. Furthermore, the surface facing the inside of the shell 103 of the head 101 constitutes a back surface 101*b*. A sensor supporting body 104 is disposed at an inner peripheral surface of this shell 103.

Figure 3:
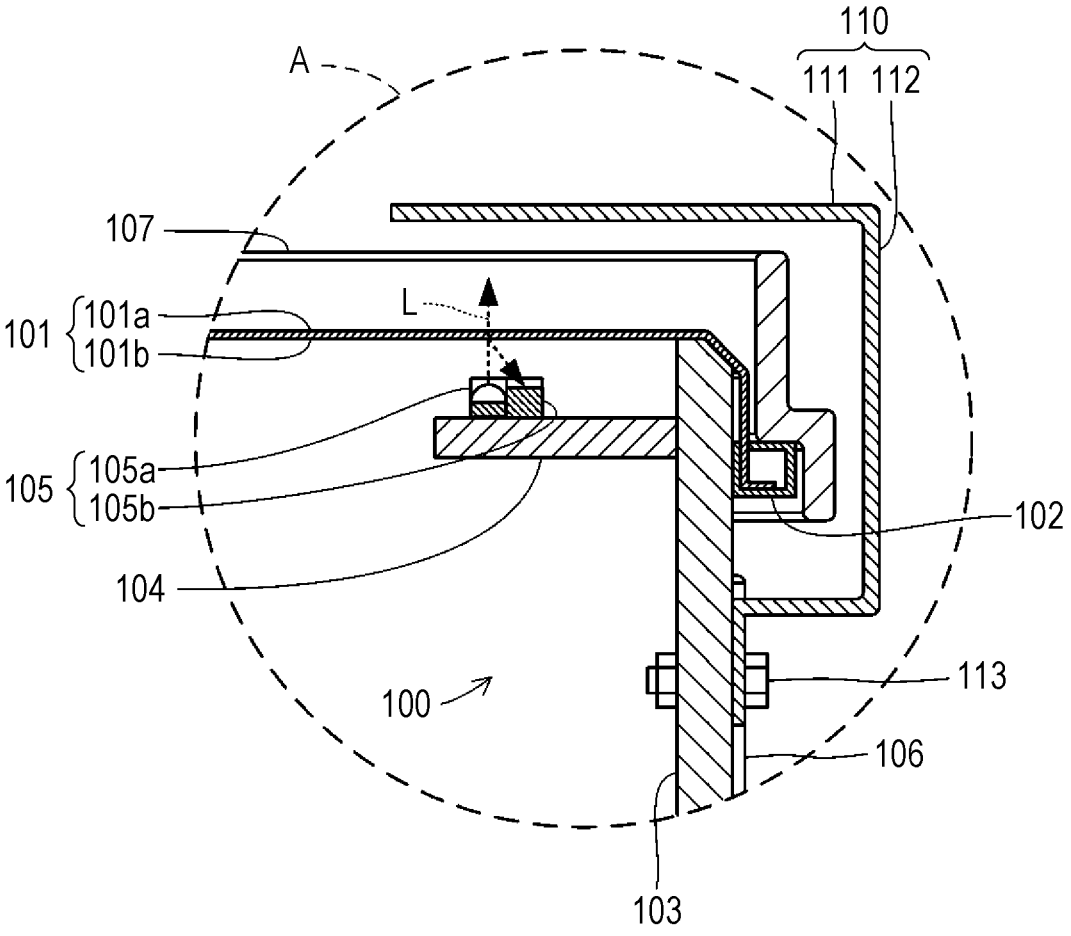
FIG. 3 is a partially enlarged cross-sectional view illustrating an inside of an enlarged dashed circle A illustrated in FIG. 2.

As illustrated in FIG. 3, the sensor supporting body 104 is a component that supports the optical sensor 105 at a position adjacent to the back surface 101*b* of the head 101. The sensor supporting body 104 is constituted of a metal plate projecting out from the inner peripheral surface of the shell 103 radially inside. In this case, the sensor supporting body 104 is preferably disposed at a position where the optical sensor 105 is not in contact with the head 101 and a position where the sensor supporting body 104 can support the optical sensor 105 on the head 101 side with respect to the head frame 102. In this case, the sensor supporting body 104 is mounted to the inner peripheral surface of the shell 103 with an adhesive, a screw (not illustrated), or the like. The optical sensor 105 is disposed on the top surface of this sensor supporting body 104.

Figure 4:
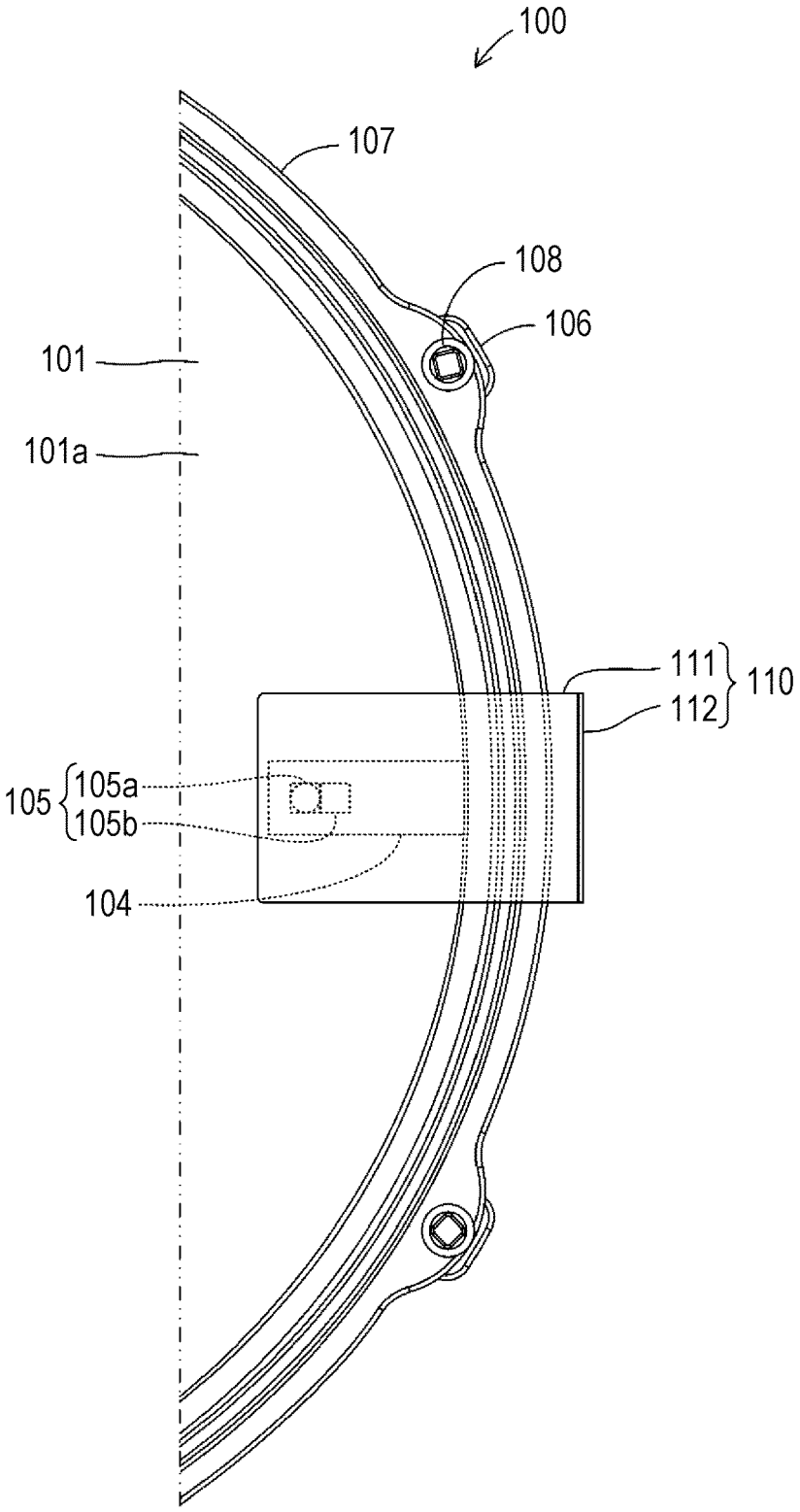
FIG. 4 is a partially enlarged plan view to describe a direction of an arrangement of an optical sensor in the electronic percussion illustrated in FIG. 1.

As illustrated in respective FIGS. 3 and 4, the optical sensor 105 is a detector that optically detects the vibration of the head 101. The optical sensor 105 is constituted so as to mainly include respective light emitter 105*a* and light receiver 105*b*. The light emitter 105*a* is a light emitting element that irradiates light to the head 101. With this embodiment, the light emitter 105*a* is constituted of an LED that emits infrared. The light receiver 105*b* is constituted of a light receiving element that outputs an electric signal according to an amount of received light. With this embodiment, the light receiver 105*b* is constituted of a phototransistor that receives the infrared.

These light emitter 105*a* and light receiver 105*b* house the exposed light emitting element and light receiving element in one rectangular parallelepiped-shaped housing made of resin. The light emitter 105*a* and the light receiver 105*b* integrally constitute the optical sensor 105. The sensor supporting body 104 supports this optical sensor 105 to a position opposed to the back surface 101*b* of the head 101. In this case, the optical sensor 105 is preferably disposed at an outer edge part of the head 101 and a position separated from a sidewall of the shell 103 inside.

The light emitter 105*a* and the light receiver 105*b* of the optical sensor 105 are disposed aligned in a radial direction of the head 101. In this case, disposing the light receiver 105*b* radially outside with respect to the light emitter 105*a* allows the optical sensor 105 to be less likely to be affected by external light. This optical sensor 105 is electrically connected to a sound source 90, which is disposed separately from the electronic percussion 100, to be removable.

Figure 5:
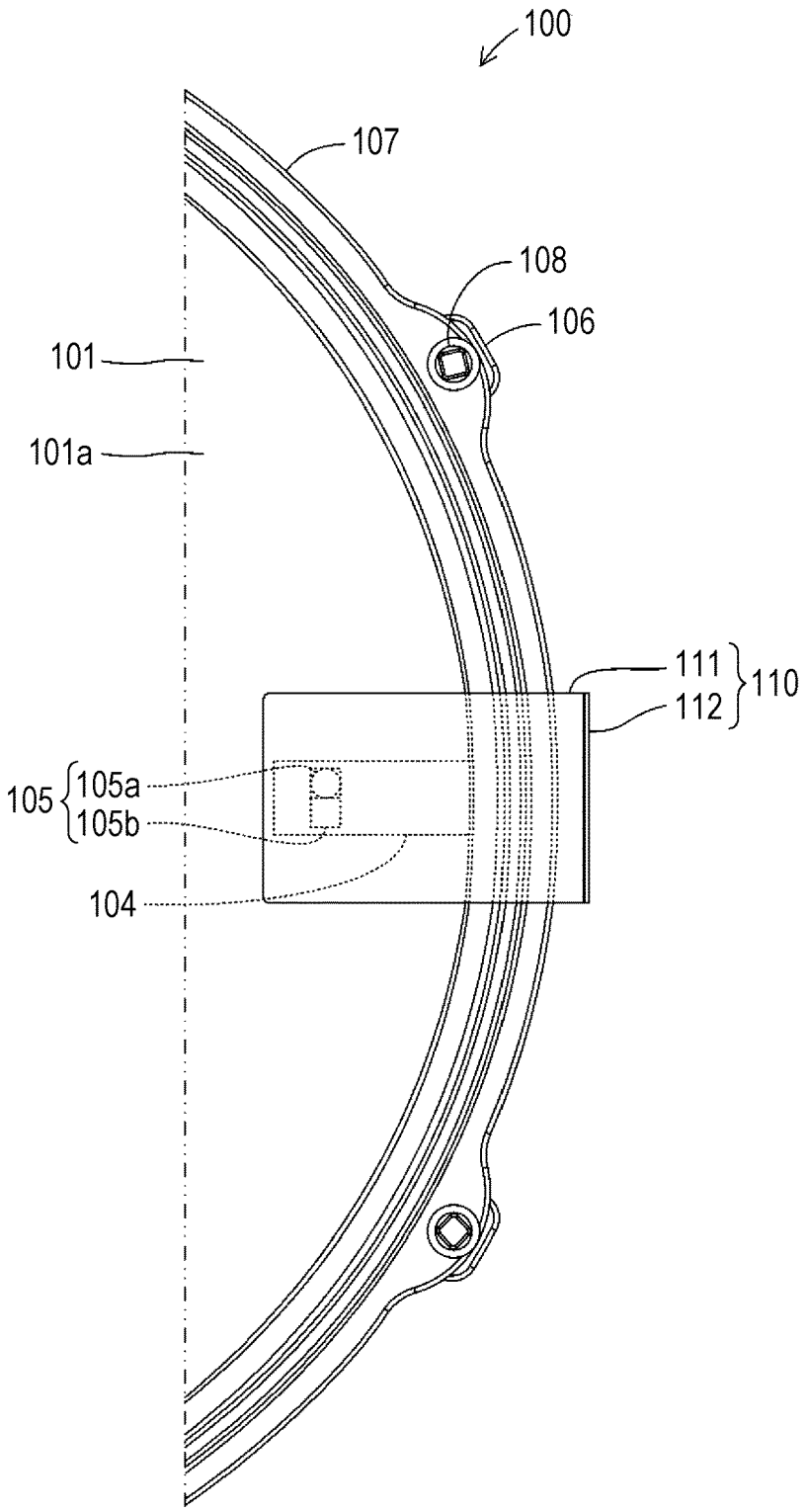
FIG. 5 is a partially enlarged plan view to describe another direction of the arrangement of the optical sensor in the electronic percussion illustrated in FIG. 1.

With this optical sensor 105, the light receiver 105*b* may be disposed radially inside with respect to the light emitter 105*a*. Alternatively, as illustrated in FIG. 5, the light emitter 105*a* and the light receiver 105*b* may be disposed aligned in a circumferential direction of the head 101. The light emitter 105*a* may be a light source unit that emits the light with a wavelength other than the infrared, for example, visible light. The light receiver 105*b* may detect, for example, the light receiving position instead of the amount of received light. Alternatively, the light receiver 105*b* may detect a time until the light receiver 105*b* receives the emitted light.

Meanwhile, respective rugs 106 and sensor cover body 110 are disposed on an outer peripheral surface of the shell 103. The rug 106 is a component to press the hoop 107 to the top surface of the head frame 102. The rugs 106 are disposed projecting out on the outer peripheral surface of the shell 103. More specifically, the rug 106 is constituted of a metallic block body extending in an axis direction of the shell 103. A female thread (not illustrated) is formed on an end surface on the head frame 102 side (the upper side in the drawing) of this block body.

Tension bolts 108 that penetrate the hoop 107 are screwed into the female threads to securely support the hoop 107 by the rugs 106. The plurality of rugs 106 is disposed along the circumferential direction of the shell 103. This embodiment includes the six rugs 106 at approximately uniform intervals mutually along the circumferential direction of the shell 103.

The hoop 107 is a component to stretch the head 101 on the shell 103 by pressing the top surface of the head frame 102 and configured by forming a metal material into a staged cylindrical shape. This hoop 107 is formed into the cylindrical shape where the one (the upper side in the drawing) end side projects out from the upper end of the shell 103 on which the head 101 is stretched and the other (the lower side in the drawing) end side projects out radially outside and then projects out from the lower end of the head frame 102. The part of the hoop 107 projecting out radially outside at the other end is mounted to the rugs 106 by the tension bolts 108.

The tension bolt 108 is a component to press the hoop 107 to the top surface of the head frame 102. The tension bolts 108 are constituted of bolts formed of male threads at an outer peripheral portion of a metallic shaft body. These tension bolts 108 are tightened to the female threads of the rugs 106 while penetrating a part of the hoop 107 where the outer diameter projects out. In view of this, by pulling the head frame 102 to the rug 106 side, the head 101 is pressed to the end of the shell 103, entering a state of being tensioned to be a flat film shape.

The sensor cover body 110 is a component to restrain light other than the light emitted by the light emitter 105*a* and reflected by the head 101 from entering the light receiver 105*b* of the optical sensor 105. The sensor cover body 110 is constituted of a plate-shaped body made of metal (for example, a steel material such as a stainless steel material) or made of resin. More specifically, the sensor cover body 110 is formed so as to have a size with which the sensor cover body 110 covers the optical sensor 105 at the position opposed to the optical sensor 105 at a surface side opposite to the surface of the head 101 facing the optical sensor 105. With this embodiment, the sensor cover body 110 is disposed at the position on the struck surface 101*a* side of the head 101 opposed to the optical sensor 105 separated from the struck surface 101*a*.

This sensor cover body 110 mainly includes a light-shielding portion 111 and a supporter 112. The light-shielding portion 111 is a part disposed above the struck surface 101*a* of the head 101 opposed to the optical sensor 105. The light-shielding portion 111 is formed into a long plate shape in a plan view extending from the outer edge portion side of the head 101 inside. In this case, the light-shielding portion 111 is formed so as to have a size (an area) larger than a size (an area) of the optical sensor 105 disposed opposed to the light-shielding portion 111 via the head 101 in a plan view.

A surface of the light-shielding portion 111 opposed to the head 101, namely, the internal surface of the light-shielding portion 111 is colored with a deep color. This embodiment colors the internal surface of the light-shielding portion 111 with black. Meanwhile, the supporter 112 is a part that supports the light-shielding portion 111 above the head 101. The supporter 112 is formed so as to project out from the outer peripheral surface of the shell 103 outside and then bend to the hoop 107 side (the upper side in the drawing) and extend in the vertical direction. This support 112 is mounted to the sidewall of the shell 103 by an attachment tool 113 formed of a bolt and a nut. With this sensor cover body 110, performing bending work on the metal plate integrally forms the light-shielding portion 111 and the supporter 112.

Figure 6:
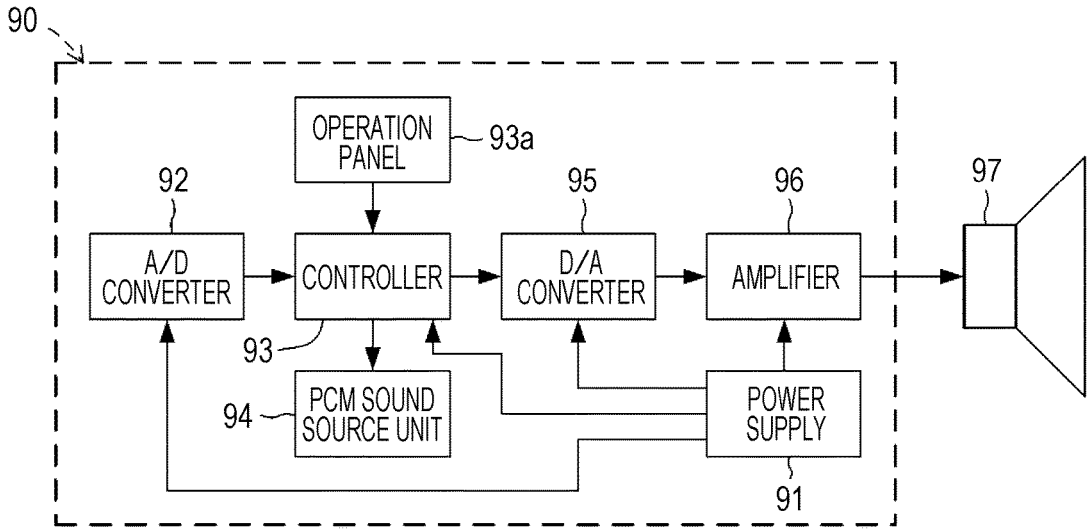
FIG. 6 is a block diagram illustrating a schematic circuit configuration of a sound source coupled to the electronic percussion illustrated in FIG. 1.

As illustrated in FIG. 6, the sound source 90 is a known electronic circuit that outputs a musical sound signal using a detection signal output from the optical sensor 105 and is constituted separated from the electronic percussion 100. This sound source 90 is constituted so as to mainly include respective power supply 91, A/D converter 92, controller 93, PCM sound source unit 94, D/A converter 95, and amplifier 96. Among these members, the power supply 91 is an electric circuit to which electric power is supplied from an electric power supply source (for example, 100 V-power supply for household) via a power supply cord (not illustrated) and supplies the electric power to the respective electric circuits of the sound source 90 and the optical sensor 105.

The A/D converter 92 is an electronic circuit that converts the analog detection signal output from the optical sensor 105 into a digital signal and outputs the digital signal to the controller 93. The controller 93 is constituted of a microcomputer constituted of a CPU, a ROM, a RAM, and the like. The controller 93 executes a control program preliminary stored in a storage device such as the ROM to generate the musical sound signal representing the musical sound using the detection signal output from the optical sensor 105 and the PCM sound source unit 94. This controller 93 also includes an operation panel 93*a* to input an instruction from the player.

The PCM sound source unit 94 is an electronic circuit storing the signal representing the musical sound by an actual musical instrument (also referred to as an "acoustic musical instrument") preliminary recorded by a pulse code modulation (PCM) method. The D/A converter 95 is an electronic circuit that converts the digital musical sound signal output from the controller 93 into the analog signal and outputs the analog signal to the amplifier 96. The amplifier 96 is an electric circuit that amplifies the analog musical sound signal output from the D/A converter 95 and outputs the amplified analog musical sound signal. Accordingly, the sound source 90 can generate the musical sound signal to emit the musical sound close to the musical sound by the acoustic musical instrument. In this case, the amplifier 96 includes an output terminal to take out the musical sound signal. In view of this, the amplifier 96 can be electrically connected to an external speaker 97.

The external speaker 97 is a device that converts the musical sound signal formed of the analog electric signal into the musical sound and is constituted separately from the sound source 90. In view of this, the sound source 90 can generate the musical sound by being electrically connected to the external speaker 97. With this embodiment, the electronic percussion 100 is configured to be a so-called external type that externally couples the speaker generating the musical sound. Obviously, the electronic percussion 100 may be configured to be a built-in type where the speaker is directly disposed at the electronic percussion 100.

(Operation of Electronic Percussion 100)

The following describes the operation of the electronic percussion 100 thus configured. First, the player prepares the respective electronic percussion 100, sound source 90, and external speaker 97. Afterwards, the player electrically connects the electronic percussion 100 to the sound source 90 and electrically connects the sound source 90 to the external speaker. Next, after powering-ON the sound source 90, the player operates the operation panel 93*a* to set the sound source 90 in a performance mode in which the sound source 90 can give a performance. Accordingly, the sound source 90 enters a state in which the sound source 90 detects the vibrations of the head 101 and can output the musical sound.

When the electric power is supplied from the sound source 90, the light emitter 105*a* of the optical sensor 105 of the electronic percussion 100 starts emitting the light. In this case, a part of emitted light L emitted from the light emitter 105*a* transmits the head 101. Furthermore, a part of the other emitted light L is reflected by the back surface 101*b* of the head 101 and is introduced to the light receiver 105*b*. In view of this, the light receiver 105*b* continuously outputs the detection signals to the sound source 90 according to the amount of received emitted light L, the reflected light from the head 101.

Next, the player adjusts the direction of the electronic percussion 100 and then starts the performance of the electronic percussion 100. Specifically, the player adjusts the electronic percussion 100 in the direction such that the side of the head 101 to which the sensor cover body 110 is opposed becomes the near-side (that is, the direction that the sensor cover body 110 is positioned at a position farthest from the player). Afterwards, the player beats the struck surface 101*a* of the head 101 using the stick or the like. Accordingly, the head 101 of the electronic percussion 100 vibrates and warps and deforms according to the performance operation by the player. Accordingly, the amount of light entering the light receiver 105*b* changes. In this case, since the part of the struck surface 101*a* of the head 101 opposed to the light receiver 105*b* is covered with the sensor cover body 110 disposed above the struck surface 101*a*, the external light is less likely to be irradiated. In view of this, as illustrated in FIG. 3, the light receiver 105*b* easily detects the emitted light L irradiated from the light emitter 105*a* and reflected by the back surface 101*b* of the head 101, outputting the detection signal according to the amount of the emitted light L.

The detection signal output from the light receiver 105*b* is input to the sound source 90. The sound source 90 generates the musical sound signal using the A/D converter 92, the controller 93, the PCM sound source unit 94, the D/A converter 95, and the amplifier 96 based on this detection signal and outputs the musical sound signal to the external speaker 97. The external speaker 97 generates the sound based on the musical sound signal output from the sound source 90. In view of this, the player can generate the musical sound according to the way of beating the struck surface 101*a* on the head 101, namely, the performance operation, from the external speaker 97.

As can be understood from the explanation on the operation, with the first embodiment, the electronic percussion 100 includes the optical sensor 105 at the one surface side of the head 101. Furthermore, the sensor cover body 110 having the size with which the optical sensor 105 is covered is disposed at the other surface side, the opposite side of the one surface. Accordingly, the amount of light (brightness) at the back surface side of the head part to which the optical sensor 105 is opposed decreases and the reflected light from the head 101 is easily detected. In view of this, the electronic percussion 100 according to the present invention can maintain the detection accuracy of the vibration of the head 101 over a long period of time.

Furthermore, the implementation of the present invention is not limited to the first embodiment, and various modifications are possible without departing from the object of the present invention. Like reference numerals designate corresponding or identical elements throughout the first embodiment and the following respective modifications, and therefore such elements will not be further elaborated here.

For example, with the first embodiment, the sensor cover body 110 is formed so as to extend from the outer peripheral surface of the shell 103. Meanwhile, it is only necessary that the sensor cover body 110 is disposed on the side opposite to the side where the optical sensor 105 is disposed on the head 101 with the size with which the optical sensor 105 is covered.

Figure 7:
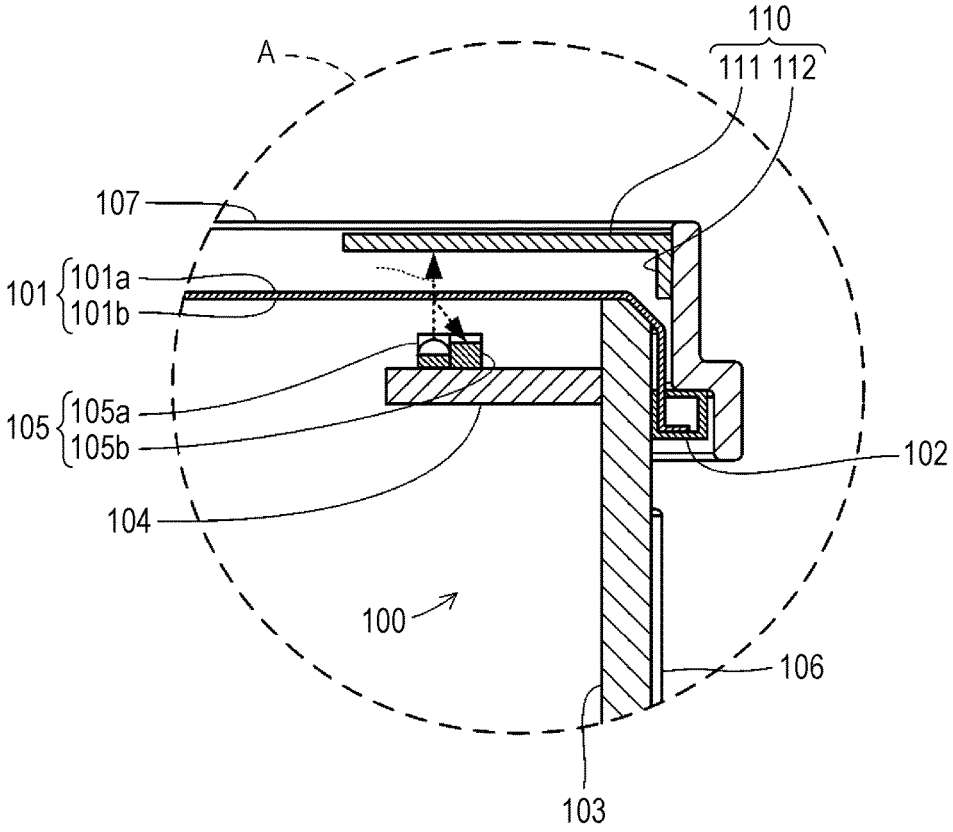
FIG. 7 is a partially enlarged cross-sectional view illustrating enlarged main parts (inside the dashed circle A illustrated in FIG. 2) of an electronic percussion according to a modification of the present invention.

Accordingly, the sensor cover body 110 can also be mounted to the hoop 107. In this case, for example, as illustrated in FIG. 7, the sensor cover body 110 can also be disposed on the inner peripheral surface of the hoop 107. According to this, since the sensor cover body 110 is disposed on the inner peripheral part of the hoop 107, the electronic percussion 100 does not have a projecting-out part, ensuring configuring the compact electronic percussion 100.

Figure 8:
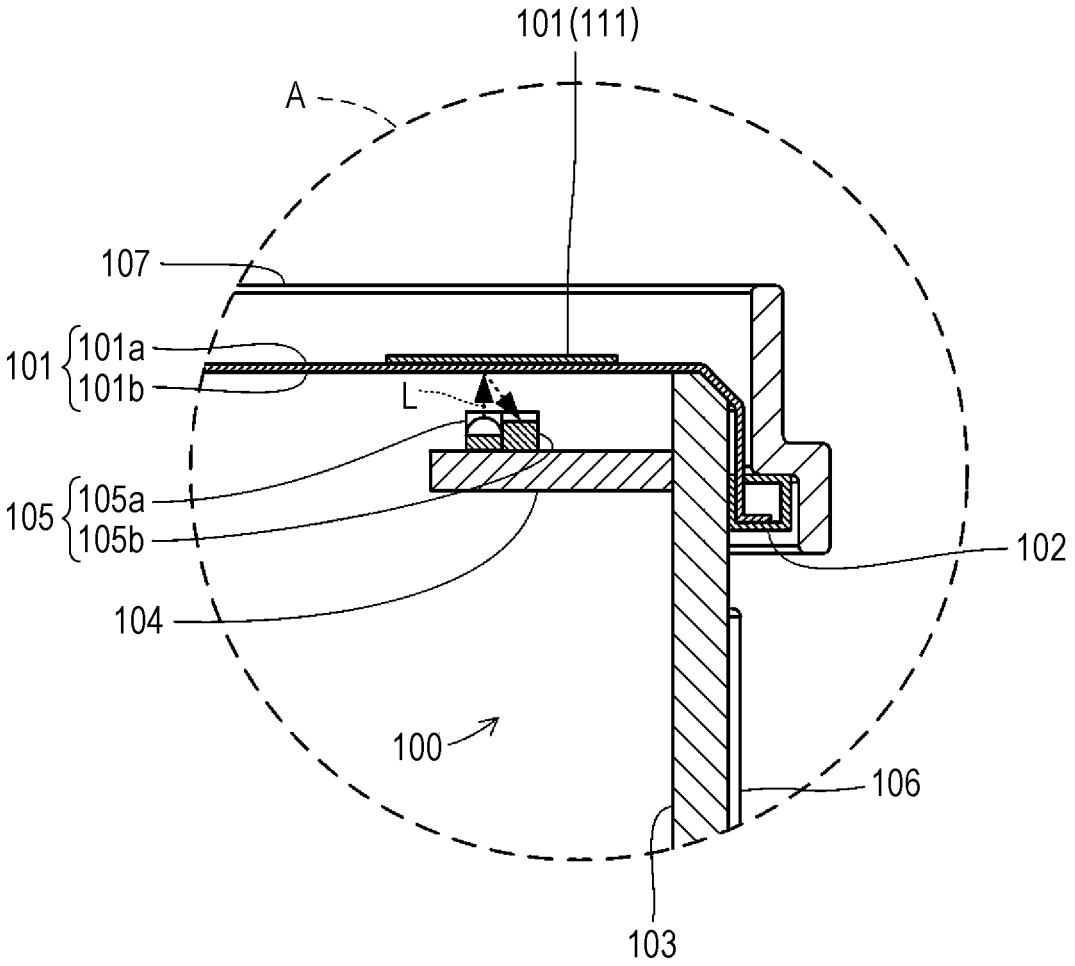
FIG. 8 is a partially enlarged cross-sectional view illustrating enlarged main parts (inside the dashed circle A illustrated in FIG. 2) of an electronic percussion according to another modification of the present invention.

The sensor cover body 110 can be disposed directly to the head 101. For example, as illustrated in FIG. 8, the sensor cover body 110 can be formed into a sheet shape and configured to be pasted to the struck surface 101*a* of the head 101. That is, the sensor cover body 110 is constituted of only the light-shielding portion 111. Accordingly, the electronic percussion 100 does not have the projecting-out part by the sensor cover body 110, ensuring configuring the compact electronic percussion 100. In this case, the sensor cover body 110 is formed into the circular shape in a plan view, allowing the sensor cover body 110 to be less likely to peel off from the head 101.

Figure 9:
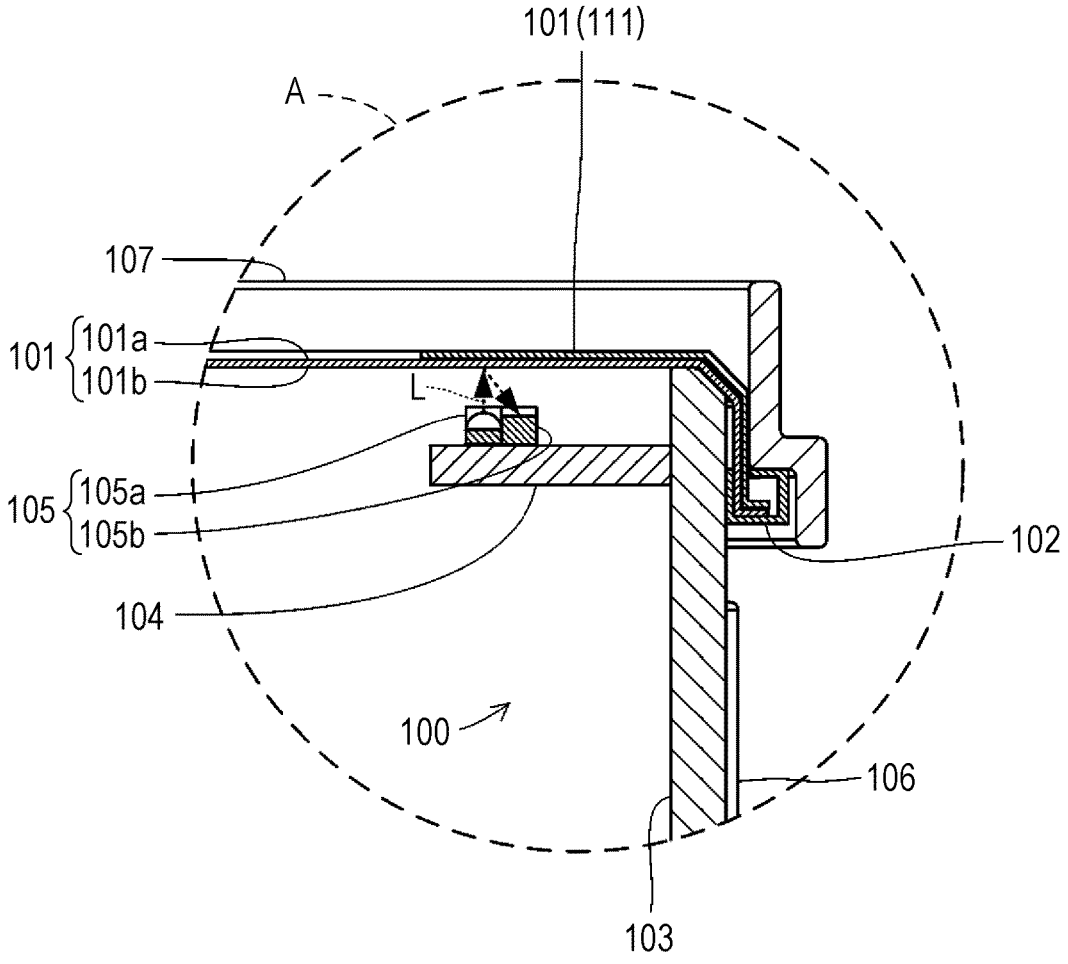
FIG. 9 is a partially enlarged cross-sectional view illustrating enlarged main parts of an electronic percussion according to another modification of the present invention.
Figure 10:
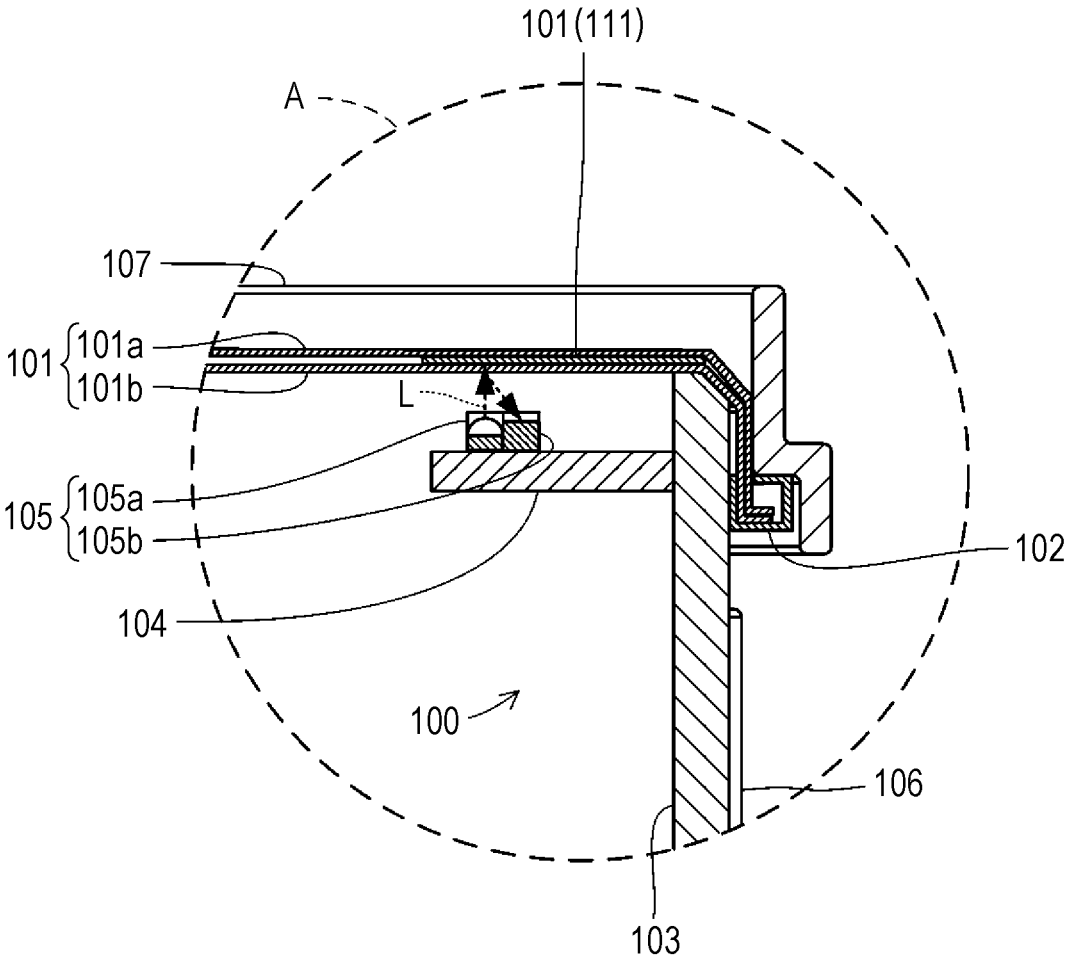
FIG. 10 is a partially enlarged cross-sectional view illustrating enlarged main parts (inside the dashed circle A illustrated in FIG. 2) of an electronic percussion according to another modification of the present invention.

As illustrated in FIG. 9, the sensor cover body 110, for example, can be constituted of a ring-shaped sheet body having an outer diameter approximately identical to the head 101. In this case, the outer edge portion of the ring-shaped sensor cover body 110 can be held to the head frame 102 together with the outer edge portion of the head 101. For example, as illustrated in FIG. 10, the sensor cover body 110 can be constituted of a ring-shaped sheet body having an outer diameter approximately identical to an exposed surface of the head 101. In this case, the ring-shaped sensor cover body 110 can be disposed sandwiched by the two heads 101. Accordingly, with the electronic percussion 100, the sensor cover body 110 is formed into an annular shape along the outer edge portions of the heads 101. When the optical sensor 105 is attached, this allows reducing a load applied to positioning between the optical sensor 105 and the sensor cover body 110. Furthermore, the electronic percussion 100 can be constituted so as to have a sophisticated design free from a feeling of a foreign body as an appearance design.

With the first embodiment the electronic percussion 100 includes the optical sensor 105 at the back surface 101*b* side of the head 101 and the sensor cover body 110 at the struck surface 101*a* side. Meanwhile, it is only necessary that the electronic percussion 100 includes the optical sensor 105 at one surface side of the head 101 and the sensor cover body 110 at the other surface side. Accordingly, the electronic percussion 100 can include the optical sensor 105 at the struck surface 101*a* side of the head 101 and the sensor cover body 110 at the back surface 101*b* side.

Figure 11:
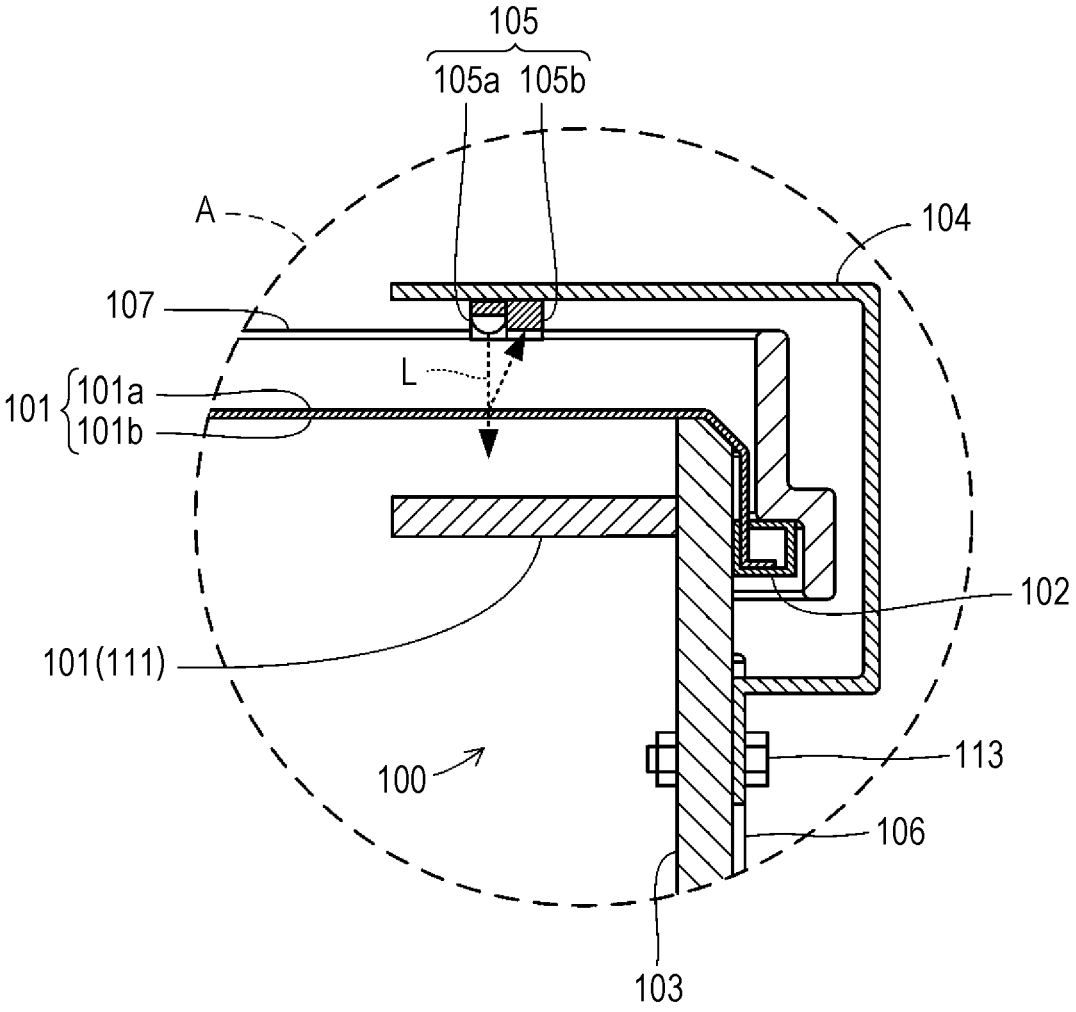
FIG. 11 is a partially enlarged cross-sectional view illustrating enlarged main parts of an electronic percussion according to another modification of the present invention.

In this case, for example, as illustrated in FIG. 11, the sensor supporting body 104 can be constituted of a plate-shaped body bending and extending from the outer peripheral surface of the shell 103 like the sensor cover body 110 according to the first embodiment. In this case, the sensor supporting body 104 can be mounted to the shell 103 by the attachment tool 113. Like the sensor supporting body 104 according to the first embodiment, the sensor cover body 110 can be constituted of a plate-shaped body extending radially inside from the inner peripheral surface of the shell 103. This facilitates post-installing the optical sensor 105 to the electronic percussion 100 without the optical sensor 105 and also allows the optical sensor 105 to be less likely to be affected by ambient light such as a spotlight during the performance. Disposing the sensor cover body 110 at the inside of the shell 103 allows cutting off the light from the lower side of the shell 103.

Figure 12:
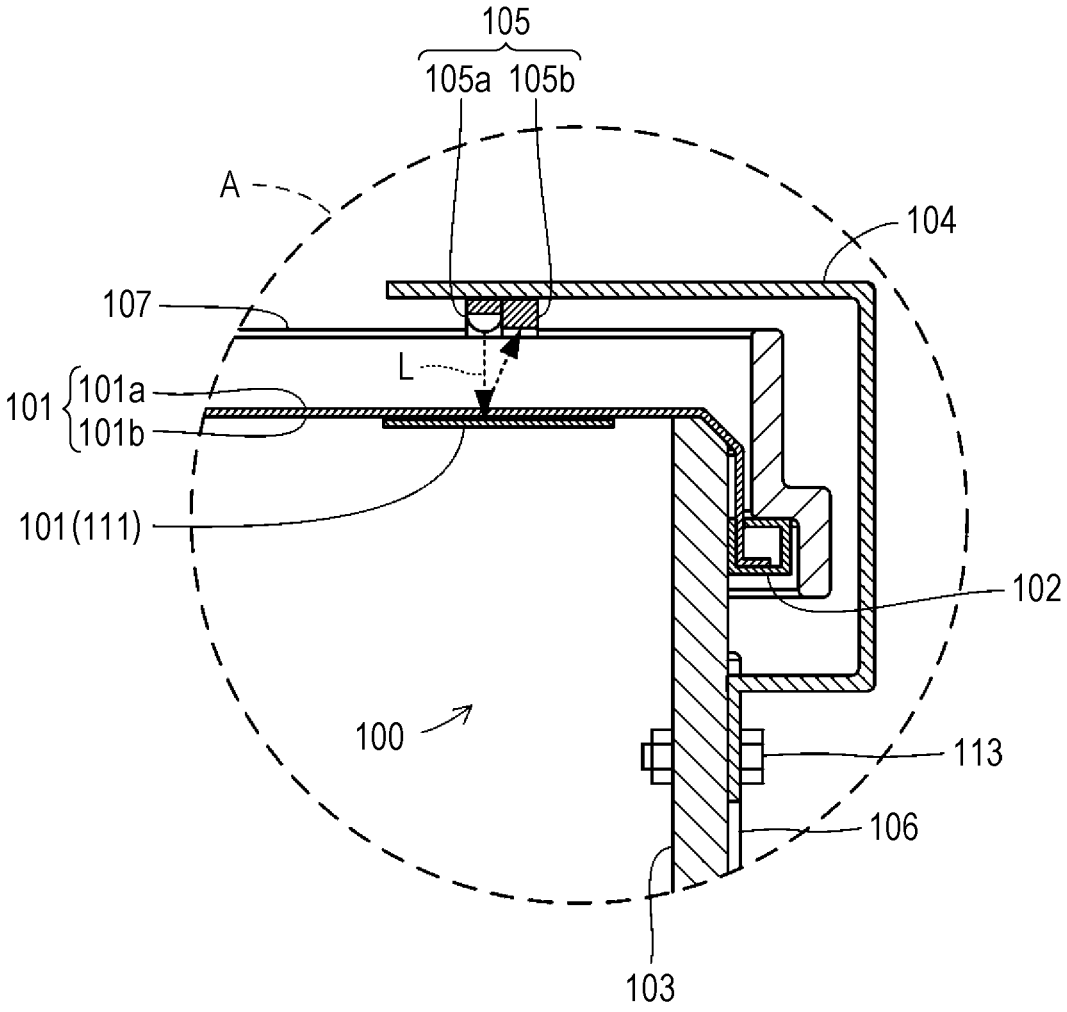
FIG. 12 is a partially enlarged cross-sectional view illustrating enlarged main parts (inside the dashed circle A illustrated in FIG. 2) of an electronic percussion according to another modification of the present invention.
Figure 13:
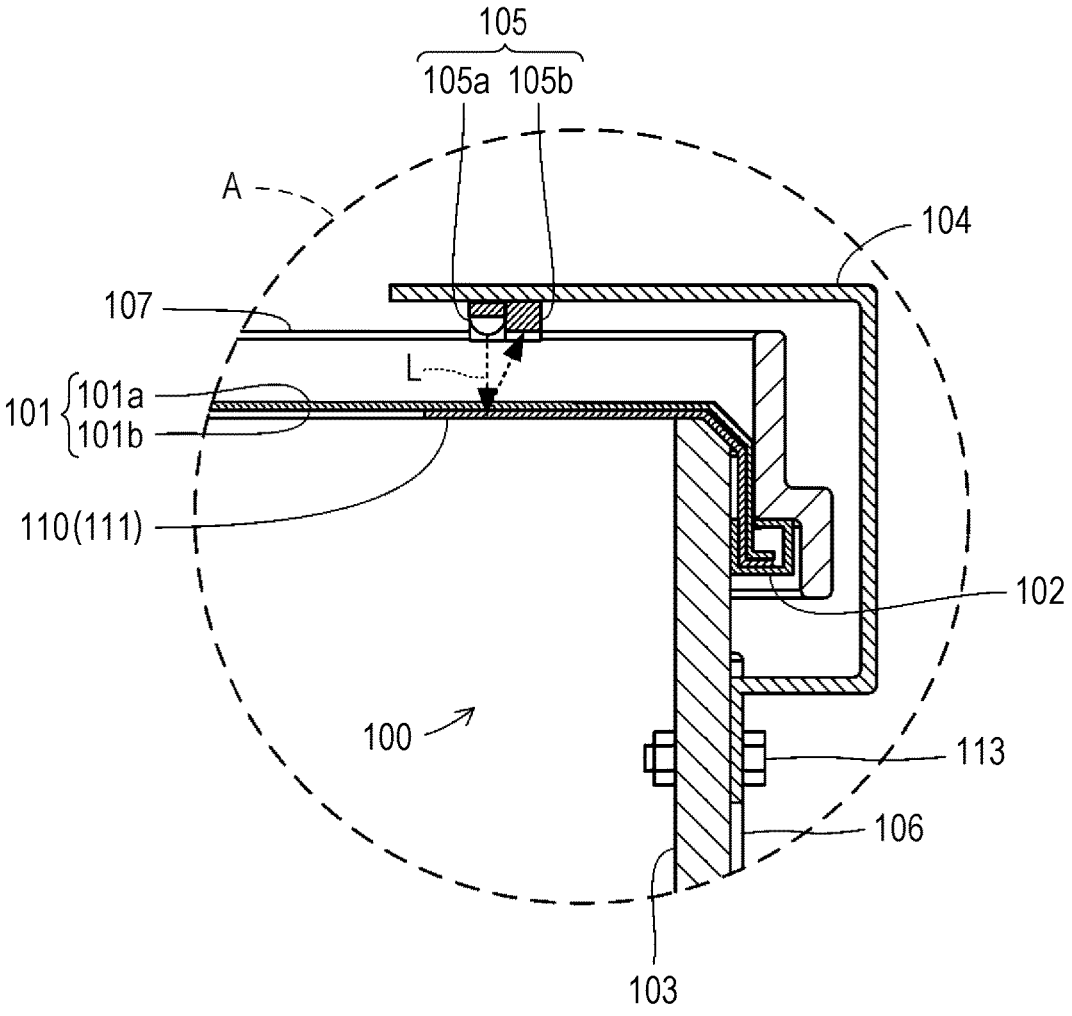
FIG. 13 is a partially enlarged cross-sectional view illustrating enlarged main parts of an electronic percussion according to another modification of the present invention.
Figure 14:
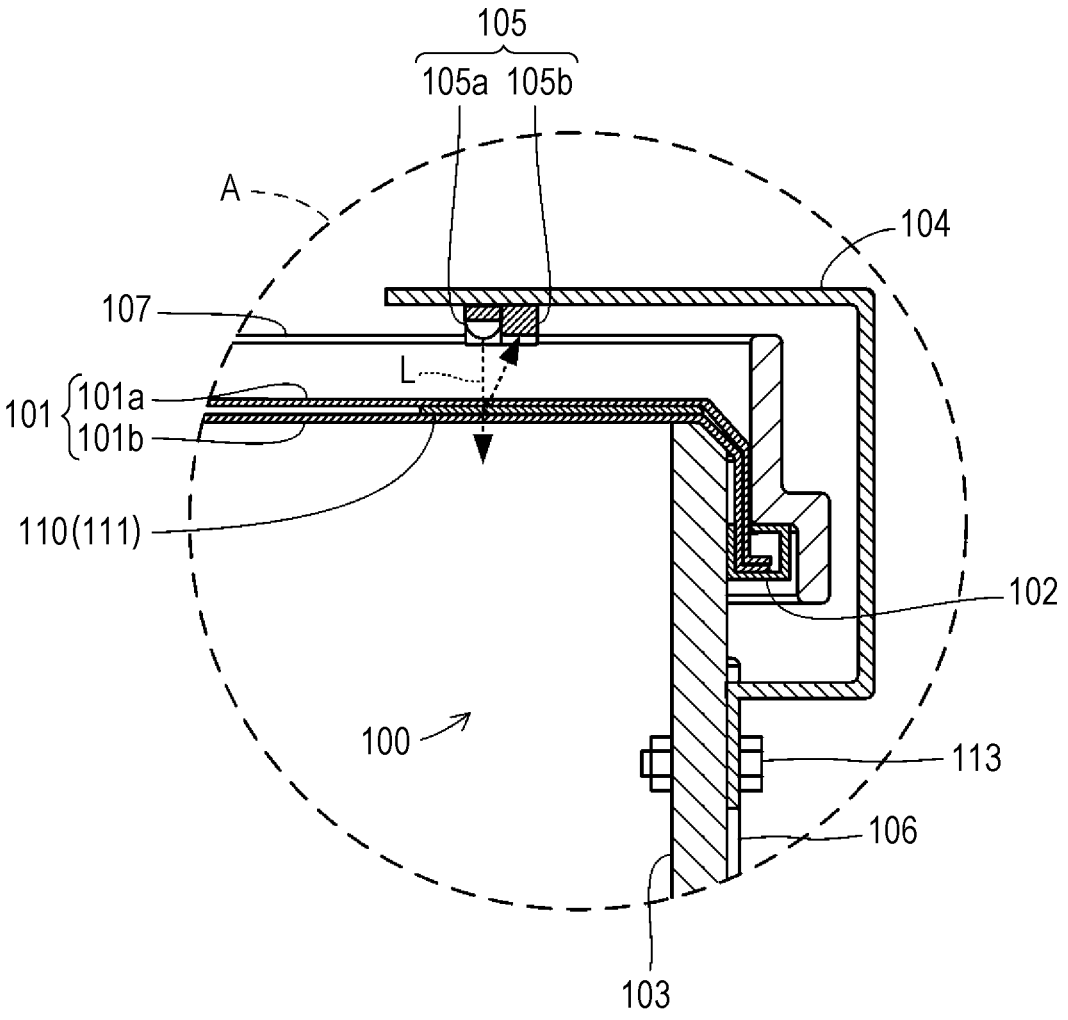
FIG. 14 is a partially enlarged cross-sectional view illustrating enlarged main parts (inside the dashed circle A illustrated in FIG. 2) of an electronic percussion according to another modification of the present invention.

When the optical sensor 105 is disposed on the struck surface 101*a* side of the head 101, the electronic percussion 100 can be configured similar to the respective electronic percussions 100 illustrated in FIGS. 8, 9, and 10. That is, as illustrated in FIG. 12, for example, the electronic percussion 100 can be constituted such that the sensor cover body 110 formed into the sheet shape is pasted to the back surface 101*b* of the head 101. For example, as illustrated in FIG. 13, the electronic percussion 100 can be configured such that the sensor cover body 110 is constituted of the ring-shaped sheet body with an outer diameter approximately identical to the head 101 and the outer edge portion is held to the head frame 102 together with the outer edge portion of the head 101. For example, as illustrated in FIG. 14, the electronic percussion 100 can be constituted such that the sensor cover body 110 is constituted of the ring-shaped sheet body having an outer diameter approximately identical to the exposed surface of the head 101 and this sensor cover body 110 is sandwiched between the two heads 101.

(Second Embodiment)

Figure 15:
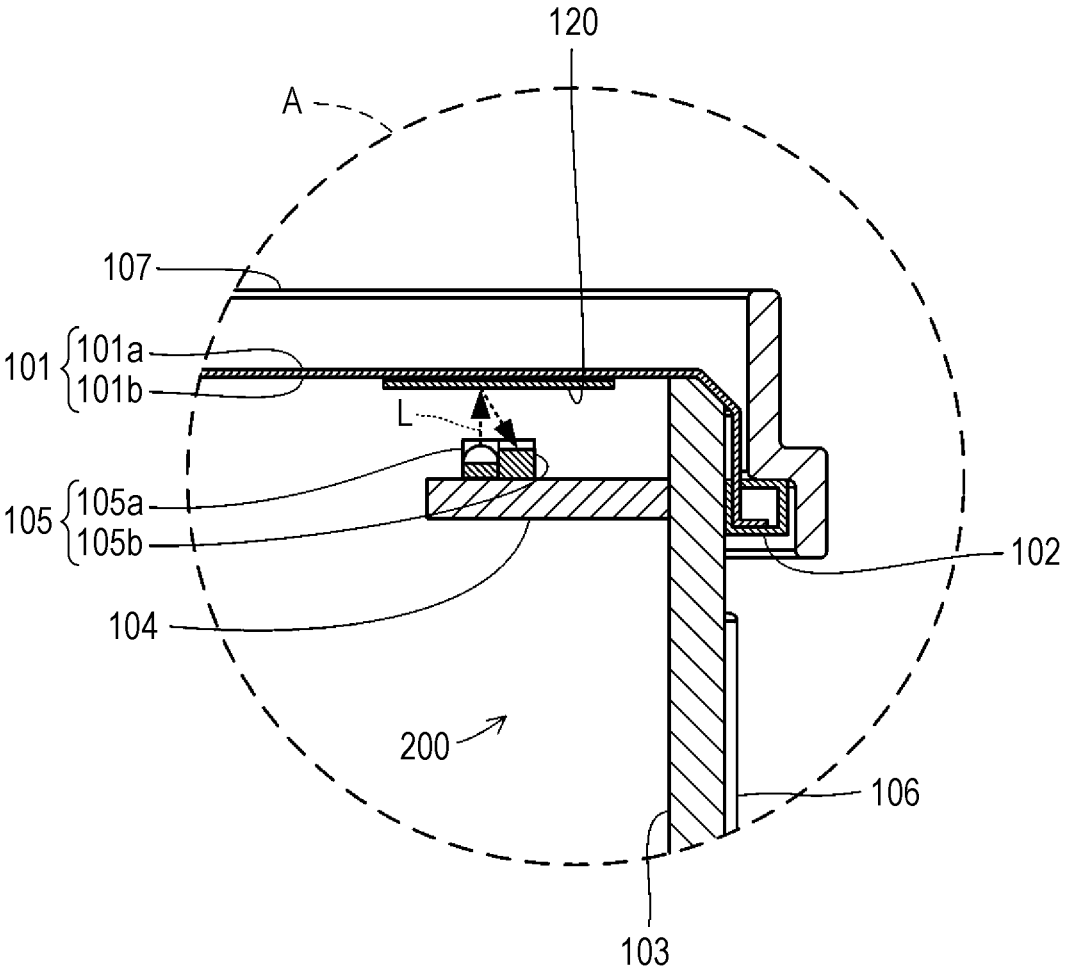
FIG. 15 is a partially enlarged cross-sectional view illustrating enlarged main parts (inside the dashed circle A illustrated in FIG. 2) of an electronic percussion according to a second embodiment of the present invention.

The following describes the second embodiment of the electronic percussion according to the present invention with reference to FIGS. 15 to 20. This second embodiment mainly describes parts different from the first embodiment. As illustrated in FIG. 15, an electronic percussion 200 according to this second embodiment features the following. The electronic percussion 200 includes the optical sensor 105, which is similar to the first embodiment, disposed opposed at one surface side of the head 101, and a sensor-opposed body 120 at a part of this head 101, disposed opposed to the optical sensor 105. The sensor-opposed body 120 has a plate shape or a flexible sheet shape that reflects the emitted light L irradiated by the light emitter 105*a*.

In this case, a surface of the sensor-opposed body 120 opposed to the optical sensor 105 is formed so as to have a high reflectivity (reflectance of 50% or more, more preferably 70% or more) such as a light color such as white or a metal color. Furthermore, the sensor-opposed body 120 is formed so as to have a size (an area) larger than a size (an area) of the optical sensor 105 in a plan view. The surface on the side opposite to the surface opposed to the optical sensor 105 of this sensor-opposed body 120 is pasted to the back surface 101*b* of the head 101.

With the electronic percussion 200 thus configured according to the second embodiment, the emitted light L emitted from the light emitter 105*a* is reflected by the sensor-opposed body 120 and a part of the emitted light L is introduced to the light receiver 105*b*. In view of this, the light receiver 105*b* continuously outputs the detection signals to the sound source 90 according to the amount of received emitted light L, the reflected light from the sensor-opposed body 120 integrated with the head 101. With the electronic percussion 200, while the player gives the performance, the sensor-opposed body 120 vibrates and warps and deforms integrally with the head 101 according to the performance operation by the player. This changes the amount of light entering the light receiver 105*b*.

In this case, the electronic percussion 200 includes the sensor-opposed body 120 with the high reflectivity at the part of the back surface 101*b* of the head 101 opposed to the light receiver 105*b*. In view of this, the light receiver 105*b* easily detects the emitted light L irradiated from the light emitter 105*a* and reflected by the sensor-opposed body 120; therefore, the detection signal according to the amount of the emitted light L can be output.

As can be understood from the explanation on the operation, with the second embodiment, with the electronic percussion 200, the sensor-opposed body 120 is less likely to partially peel off and drop due to the hitting of the head 101. Accordingly, the detection accuracy of the vibration of the head 101 can be maintained over a long period of time. The electronic percussion 200 includes the respective optical sensor 105 and sensor-opposed body 120 at the back surface 101*b* side of the head 101. Therefore, the appearance can be better. In the case where the head 101 is formed into the mesh pattern in the electronic percussion 200, since the sensor-opposed body 120 is formed into the planar shape, the sensor-opposed body 120 can efficiently reflect the emitted light L emitted from the light emitter 105*a*.

Furthermore, the implementation of the present invention is not limited to the second embodiment, and various modifications are possible without departing from the object of the present invention. Like reference numerals designate corresponding or identical elements throughout the second embodiment and the following respective modifications, and therefore such elements will not be further elaborated here.

Figure 16:
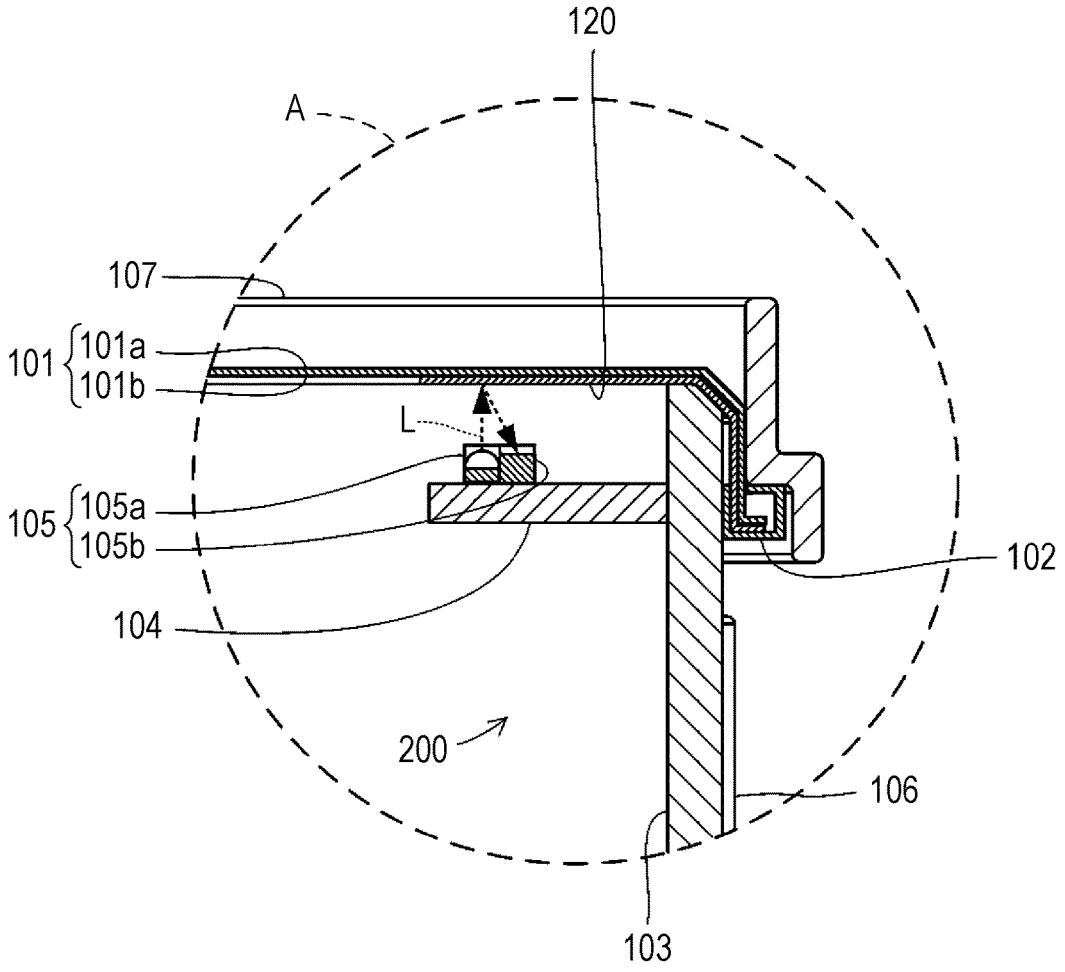
FIG. 16 is a partially enlarged cross-sectional view illustrating enlarged main parts of an electronic percussion according to a modification of the present invention.

For example, with the second embodiment, the sensor-opposed body 120 can be formed into the circular shape in a plan view. Meanwhile, as illustrated in FIG. 16, the sensor-opposed body 120, for example, can be constituted of a ring-shaped sheet body having an outer diameter approximately identical to the head 101. In this case, the outer edge portion of the ring-shaped sensor-opposed body 120 can be held to the head frame 102 together with the outer edge portion of the head 101.

With the second embodiment, the electronic percussion 200 includes the respective optical sensor 105 and sensor-opposed body 120 at the back surface 101*b* side of the head 101. Meanwhile, it is only necessary that the electronic percussion 200 includes the respective optical sensor 105 and sensor-opposed body 120 at one surface side of the head 101. Accordingly, the electronic percussion 200 can also be configured such that the respective optical sensor 105 and sensor-opposed body 120 are disposed at the struck surface 101*a* side of the head 101.

Figure 17:
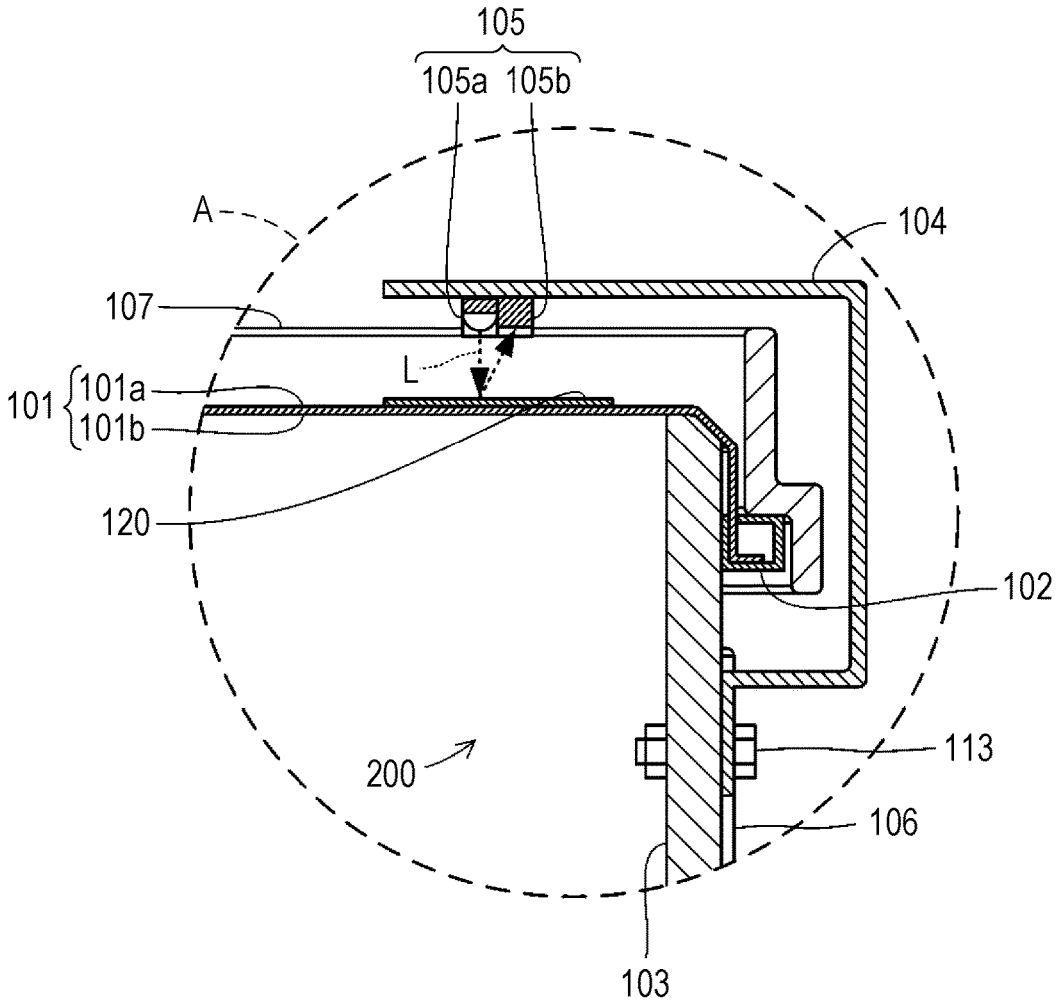
FIG. 17 is a partially enlarged cross-sectional view illustrating enlarged main parts (inside the dashed circle A illustrated in FIG. 2) of an electronic percussion according to another modification of the present invention.

In this case, for example, as illustrated in FIG. 17, the optical sensor 105 is supported to a position separated from the struck surface 101*a* of the head 101 by the sensor supporting body 104 formed of the plate-shaped body bending and extending from the outer peripheral surface of the shell 103 similar to FIG. 11. Similar to the second embodiment, the sensor-opposed body 120 can be constituted so as to be formed into the plate shape or the sheet shape and be directly pasted on the struck surface 101*a* of the head 101 to which the optical sensor 105 supported by the sensor supporting body 104 is opposed.

Figure 18:
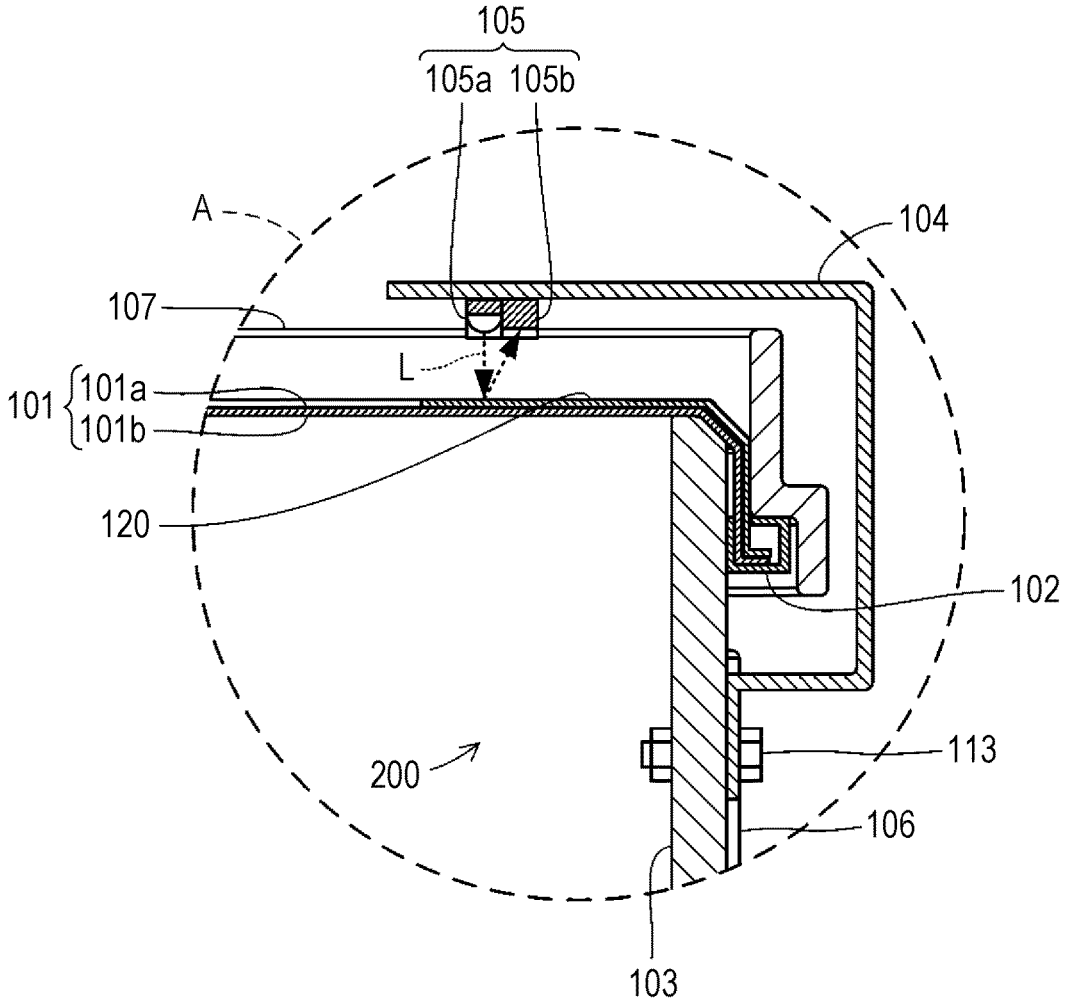
FIG. 18 is a partially enlarged cross-sectional view illustrating enlarged main parts (inside the dashed circle A illustrated in FIG. 2) of an electronic percussion according to another modification of the present invention.

As illustrated in FIG. 18, the sensor-opposed body 120, for example, can be constituted of the ring-shaped sheet body having an outer diameter approximately identical to the head 101 similar to FIG. 16. In this case, the outer edge portion of the ring-shaped sensor-opposed body 120 can be held to the head frame 102 together with the outer edge portion of the head 101.

The first embodiment and the second embodiment integrally configure the light emitter 105*a* and the light receiver 105*b* in the optical sensor 105. Meanwhile, the respective light emitter 105*a* and light receiver 105*b* may be constituted separately in the optical sensor 105.

The first embodiment and the second embodiment include the optical sensor 105 at the end of the head 101 on the side opposite to the player side. In view of this, the electronic percussions 100 and 200 include the optical sensor 105 at the end of the head 101 on the side opposite to the player side. This ensures facilitating the performance and also can prevent received damage of the optical sensor 105, the sensor cover body 110, and the sensor-opposed body 120. Meanwhile, as long as the optical sensor 105 is at the position where the vibration of the head 101 can be optically detected, the position is not always limited to the respective embodiments.

Accordingly, the optical sensor 105, for example, may be disposed at one or both of right and left end sides with respect to the player. That is, the one electronic percussion 100 can include the plurality of optical sensors 105. In this case, the electronic percussion 100 can be constituted so as to generate the musical sound according to an addition of the respective detection signals from the plurality of optical sensors 105 or the musical sound according to the respective detection signals.

With this embodiment, the electronic percussion 100 is constituted of a snare drum type electronic drum. Meanwhile, the electronic percussion 100 is widely applicable to an electronic musical instrument that detects the vibration and the pressure change on the struck surface when the struck surface is beaten and rubbed by the hand, the stick, or the like to generate the electronic musical sound. Accordingly, the electronic percussion 100 can be configured as an electronic bass drum or an electronic percussion.

DESCRIPTION OF REFERENCE SIGNS

L: Emitted light
90: Sound source
91: Power supply
92: A/D converter
93: Controller
93*a*: Operation panel
94: PCM sound source unit
95: D/A converter
96: Amplifier
97: External speaker
100, 200: Electronic percussion
101: Head
101*a*: Struck surface
101*b*: Back surface
102: Head frame
103: Shell
104: Sensor supporting body
105: Optical sensor
105*a*: Light-emitting device
105*b*: Light receiver
106: Rug
107: Hoop
108: Tension bolt
110: Sensor cover body
111: Light shielding portion
112: Supporter
113: Attachment tool
120: Sensor-opposed body

The invention claimed is:

1. An electronic percussion comprising:

a head configured such that a struck surface beaten by a player has a semi-translucency that causes a part of irradiated light to transmit and reflects another part of the light;

an optical sensor disposed opposed at one surface side of the head, the optical sensor including respective light emitter and photoelectric converter, the light emitter being configured to irradiate the head with light, the photoelectric converter being configured to photoelectrically convert a received light; and a sensor cover body disposed at a position that is opposed to the optical sensor and at another surface side of the head, the sensor cover body having a size with which the optical sensor is covered.

2. The electronic percussion according to claim 1, wherein the sensor cover body is disposed opposed at a position separated from the other surface side of the head.

3. The electronic percussion according to claim 1, wherein the sensor cover body is disposed directly on the other surface of the head.

4. The electronic percussion according to claim 3, wherein the sensor cover body is formed into an annular shape along an outer edge portion of the head.

5. The electronic percussion according to claim 1, further comprising:

a tubular shell that supports the outer edge portion of the head; and a sensor supporting body disposed at a side surface of the shell, the sensor supporting body supporting the optical sensor at a position adjacent to the head.

6. The electronic percussion according to claim 1, wherein the optical sensor is disposed at an end of the head on a side opposite to the player side.

7. The electronic percussion according to claim 1, wherein the sensor cover body has a side facing the optical sensor, the side being colored with a deep color.

8. An electronic percussion comprising:

a head configured such that a struck surface beaten by a player has a semi-translucency that causes a part of irradiated light to transmit and reflects another part of the light;

an optical sensor disposed opposed at one surface side of the head, the optical sensor including respective light emitter and photoelectric converter, the light emitter being configured to irradiate the head with light, the photoelectric converter being configured to photoelectrically convert a received light; and a sheet-shaped or plate-shaped sensor-opposed body disposed directly on the one surface of the head, the sensor-opposed body being configured to reflect the light irradiated by the light emitter.

9. The electronic percussion according to claim 8, wherein the sensor-opposed body is formed into an annular shape along an outer edge portion of the head.

* * * * *